US005442817A

United States Patent [19]

Miner

[11] Patent Number: 5,442,817

[45] **Date of Patent: * Aug. 22, 1995**

[54] CARDBOARD EMBLEM BEARING CAP ATTACHMENT FOR ADJUSTABLE CAPS

[75] Inventor: Jon S. Miner, New Brighton, Minn.

[73] Assignee: InterNatural Designs, Inc., Minneapolis, Minn.

[ * ] Notice: The portion of the term of this patent subsequent to Feb. 1, 2011 has been disclaimed.

[21] Appl. No.: 96,694

[22] Filed: Jul. 23, 1993

[51] Int. Cl.[6] ..... A42B 1/24

[52] U.S. Cl. ..... 2/195.1; 2/209.13; 2/181.4; 40/329

[58] Field of Search ..... 2/181, 181.4, 181.6, 2/181.8, 182.1, 182.2, 182.3, 182.5, 185 R, 199, 244, 246, DIG. 11, 195.1, 195.2, 209.13, 918; 40/329, 299, 330, 665

[56] References Cited

U.S. PATENT DOCUMENTS

| | | | |
|---|---|---|---|
| Re. 33,430 | 11/1990 | Nunnery | 2/DIG. 11 |
| 1,667,162 | 4/1928 | Kuhns | 40/329 |
| 4,198,772 | 4/1980 | Furutu | 40/665 |
| 4,776,043 | 10/1988 | Coleman | 2/199 |
| 4,856,214 | 8/1989 | Machen | 40/665 |
| 4,872,218 | 10/1989 | Holt | 2/171.5 |
| 5,003,640 | 4/1991 | Pizzacar | 2/199 |
| 5,025,504 | 6/1991 | Benston | 2/181.4 |
| 5,046,195 | 9/1991 | Koritan | 2/172 |
| 5,107,548 | 4/1992 | Dotzenrod | 2/209.1 |
| 5,136,726 | 8/1992 | Kellin | 2/244 |
| 5,153,943 | 10/1992 | Clement | 2/199 |
| 5,161,259 | 11/1992 | Shorts | 2/199 |
| 5,170,509 | 12/1992 | Leopold | 2/199 |
| 5,282,278 | 2/1994 | Miner | 2/209.13 |
| 5,287,559 | 2/1994 | Christiansen et al. | 2/209.13 |

*Primary Examiner*—Clifford D. Crowder
*Assistant Examiner*—Diana L. Biefeld
*Attorney, Agent, or Firm*—Palmatier, Sjoquist & Helget

[57] ABSTRACT

An emblem bearing cap attachment has a substantially planar, relatively stiff body defining a forward surface and a rearward surface. A primary crease or folding line extends centrally across the planar body defining an upper facing panel and a lower backing panel. The folding line facilitates folding of the body about and capturing the adjustable straps of a baseball style cap to position the rearward surface of the facing panel in confronting relationship with the rearward surface of the backing panel whereat are fastening means to secure the panels together. The facing panel completely closes the semicircular opening at the rear of the cap and allows the display of emblems or other indicia thereon.

12 Claims, 2 Drawing Sheets

CARDBOARD EMBLEM BEARING CAP ATTACHMENT FOR ADJUSTABLE CAPS

BACKGROUND OF THE INVENTION

This invention relates to baseball style adjustable caps, and more particularly to an emblem bearing cap attachment for such caps.

For as long as there has been baseball, there have been baseball caps. People wear their caps for all occasions. They are generally made of a fabric or woven material having a hemispherical crown. The crown may also be cylindrical with a flat top. Inside the crown at the lower periphery is located a rim or band of reinforced or padded material for securing the cap to the head. At the forward lower periphery portion of the crown is located a stiff visor or bill to assist in keeping the sun out of the eyes of the wearer. This construction is universal with respect to all known baseball style caps.

At the rearward portion of the crown, the baseball caps begin to somewhat deviate. There are customized caps which have a continuous rim or band around the lower periphery of the crown for exact size fitting for a specific head size. Baseball caps are also made which are adjustable. At the rearward portion of the crown, they have a semicircular opening whereat the band or rim stops and a band sizing adjustment strap begins. The adjustment straps or strap may be elastic, leather with a buckle or plastic. The plastic straps are common wherein one strap has protruding beads or knobs which are receivably interlockable with cooperating apertures on the other strap upon overlap of the straps for adjusting the cap. Most people consider the semicircular opening at the rear portion of the crown to be unsightly despite being necessary to permit the cap to be adjustable.

Recently it has become a fad for kids and young adults to wear their baseball caps with the visor or bill directed rearwardly. Wearing the cap in this orientation places great emphasis on the unsightly semicircular opening. Additionally, the band size adjustment straps are generally not designed to be comfortably worn along the forehead and may cause irritation. Further, the adjustment strap may not absorb perspiration or sweat as will the padded band when the hat is worn in its normal forward position.

There is a need for an emblem bearing cap attachment which will secure about the band sizing adjustment straps to completely cover the semicircular opening and permit the display of emblems or other indicia at the rear of the cap.

SUMMARY OF THE INVENTION

An emblem bearing cap attachment has a substantially planar, relatively stiff body defining a forward surface and a rearward surface. A primary crease or folding line extends centrally across the planar body defining an upper facing panel and a lower backing panel. The folding line facilitates folding of the body about and capturing the adjustable straps of a baseball style cap to position the rearward surface of the facing panel in confronting relationship with the rearward surface of the backing panel whereat are fastening means to secure the panels together. The facing panel completely closes the semicircular opening at the rear of the cap and allows the display of emblems or other indicia thereon.

A principal object and advantage of the present invention is that the emblem bearing cap attachment conceals the semicircular opening at the rearward portion of the crown together with concealing the adjustable straps thereby making the cap aesthetically more appealing and appearing.

Another object and advantage of the present invention is that the emblem bearing cap attachment permits the additional display on the cap of a name, emblem, crest, advertisement, trademark, team name, number or other indicia by way of imprinting or embroidery.

Another object and advantage of the present invention is that the cap attachment is made of paper, cardboard, kimdura or plastic material which fits against the forehead and covers the adjustment straps to increase comfort when the cap is worn backwards.

Another object and advantage of the present invention is that it gives the adjustable cap the appearance of being custom made.

Another object and advantage of the present invention is that the cap attachment is simple and inexpensive to manufacture in mass quantities with precise and well defined shapes for advertising.

Another object and advantage of the present invention is that the cap attachment is easy to install and may last for years.

Other objects and advantages will become readily apparent upon review of the following figures, specification, and appended claims.

DETAILED DESCRIPTION

Figure 1:
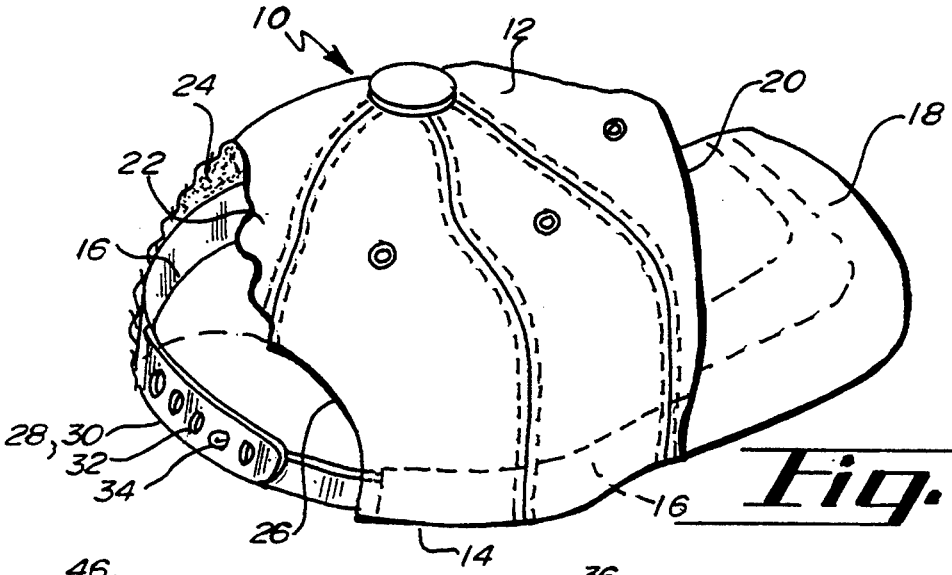
FIG. 1 is a partially broken away rear perspective view of an adjustable baseball style cap.
Figure 2:
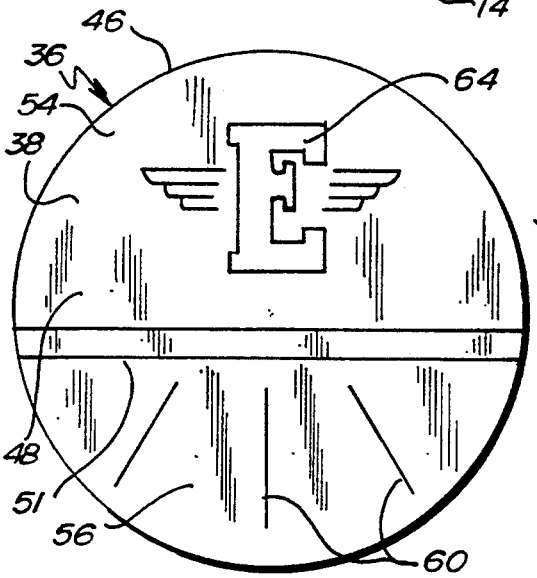
FIG. 2 is a front elevational view of the emblem bearing cap attachment of the present invention.
Figure 3:
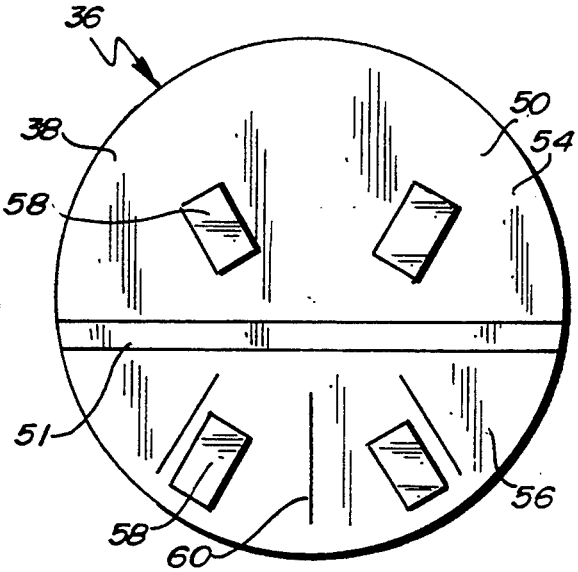
FIG. 3 is a rear elevational view of the cap attachment.
Figure 7:
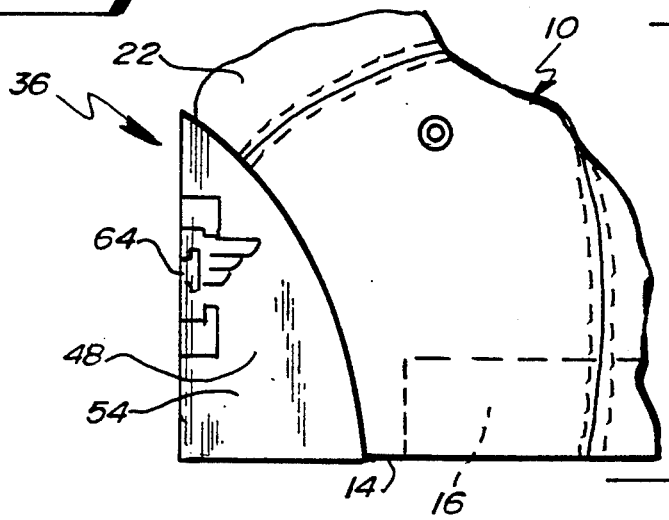
FIG. 7 is a side elevational view of the cap attachment secured to a cap.
Figure 4:
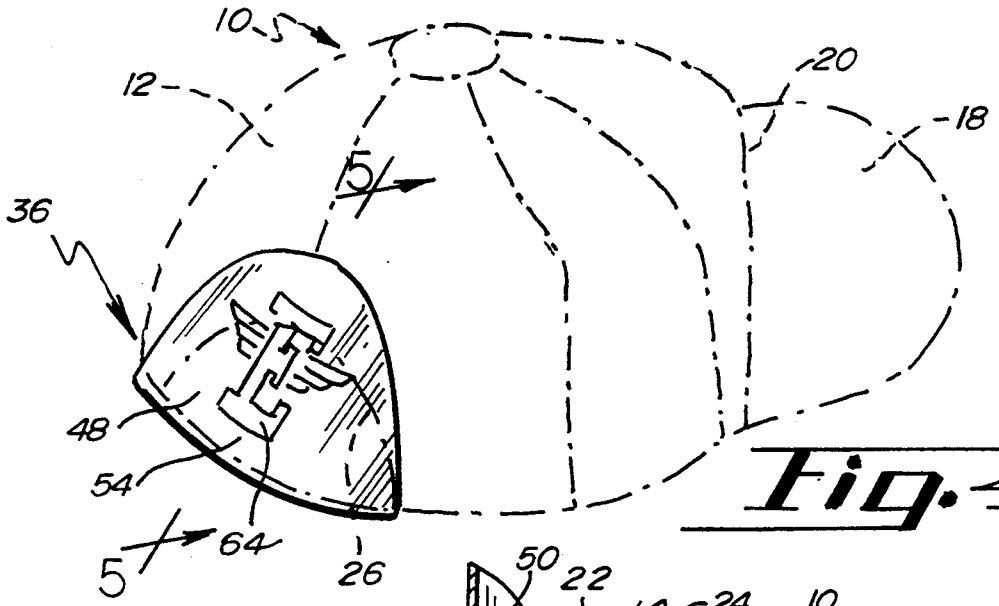
FIG. 4 is a perspective view of the cap in phantom outline supporting the emblem bearing cap attachment.
Figure 5:
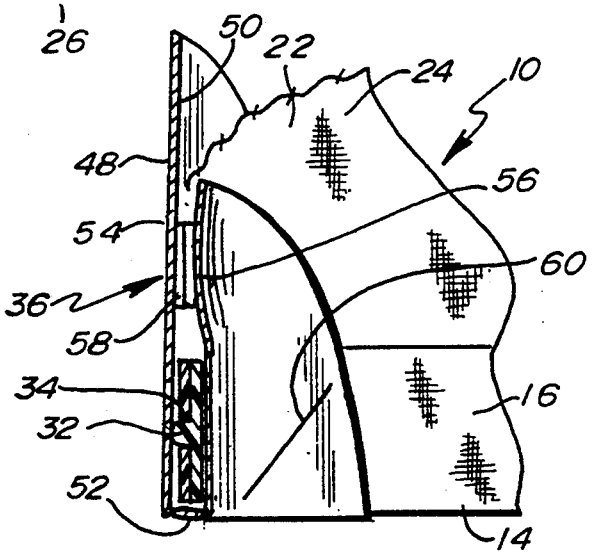
FIG. 5 is a cross sectional view taken through lines 5—5 of FIG. 4.
Figure 6:
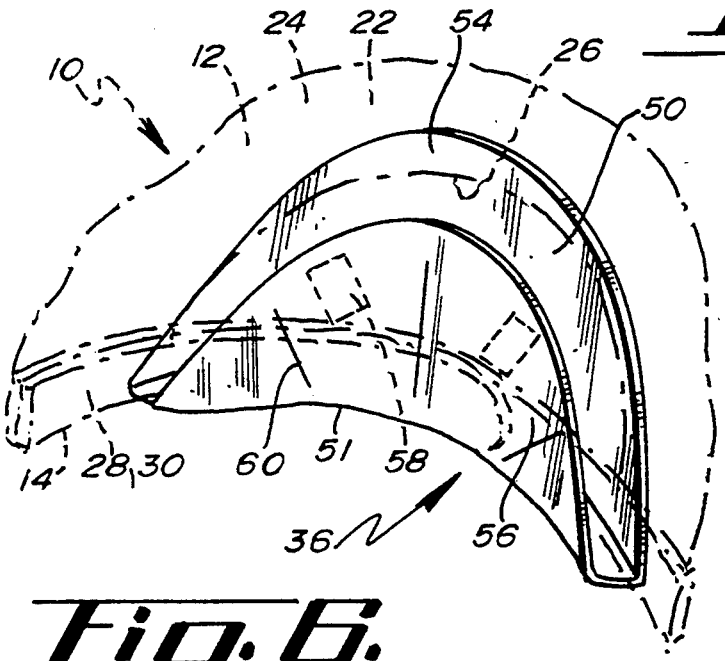
FIG. 6 is a perspective view taken from inside the cap looking rearwardly showing the cap attachment secured to the cap which is shown in phantom outline.

Referring to FIG. 1, a baseball style cap 10 generally has a hemispherical crown 12 made of pliable fabric or cloth. The crown 12 may also take the shape of a cylinder with a flat top. The crown 12 has a lower periphery 14 where at a padded or reinforced rim or band 16 extends substantially around the lower periphery 14 of the crown 12. A stiff visor or bill 18 extends forwardly from the crown forward portion 20 at the lower periphery 14. At the crown rearward portion 22 is located a semicircular opening 26 which allows for adjustment of the cap 12 and unsightly viewing to the inside 24 of the cap. Extending along the lower periphery 14 from the inside 24 of cap 10 is a band sizing adjustment strap or straps 28 which may be an elastic material, a leather strap and buckle arrangement or plastic straps 30. The plastic straps 30 have beads 32 which are receivably capturable by apertures 34 for securely adjusting the straps 28.

Referring to FIGS. 2 through 7, the emblem bearing cap attachment 36 may be appreciated. The cap attachment 36 has a planar body 38 which may have a circular profile but may take other shapes on the upper portions of the body 38 for aesthetic purposes. Planar body 38 is relatively stiff and suitably made of cardboard, construction paper, kimdura or plastic. The planar body 38 may be die cut to a particular shape, such as by stamping, to achieve any of a variety of shapes including circular, crested, scalloped or combed. The planar body 38 is ideal for mass manufacturing as the cap attachment 36 may have its shape maintained mechanically in its assembly free of human error.

The cap attachment 36 has a forward surface 48 and a rearward surface 50. Extending centrally across the planar body 38 is a primary folding line or crease 52 which suitably is horizontal and facilitates a folding of the planar body 38. The folding line may also be a scoring made on the body during die cutting. The primary crease 52 defines an upper facing panel 54 and a lower backing panel 56. At the rearward surface 50 spaced equal distance from the primary crease 52 are located fastening means 58. Fastening means 58 suitably may be double-sided adhesive tapes, hook and loop material (VELCRO), snaps, double-sided adhesive tapes, buttons or hooks and eyes or loops. The fastening means 58 on the rear surface 50 of the facing and backing panels 54 and 56 are alignable upon folding of the planar body 38. Also in the backing panel are optionally located secondary creases 60 or fold lines which radiate outwardly from the central regions of the planar body 38. The secondary creases 60 facilitate arcuate bending of the backing panel 50 to conform to the circular shape of the lower periphery 14 of the cap 10, the plastic straps 30 and the human head.

On the forward surface 48 of the facing panel 54 may be located indicia 64 which may be a name, emblem, crest, advertisement, trademark, team name, number or other matter whether printed or embroidered. The relatively stiff planar body 38 may also have a raised or relief area 62 which gives the indicia 64 an embossed look.

The use of the cap attachment 36 may now be appreciated. The individual takes his cap 10 and the planar body 38 and begins to fold the body 38 at the primary crease 52 which is positioned to abut against the bottom of the plastic straps 30. As the backing panel 56 is swung toward the facing panel 56 on the inside 24 of the cap 10, the respective fastening means 58 are engaged just above the plastic straps 30. Now the cap attachment 36 is secured to the cap which now may comfortably be worn in a forward or rearward orientation. The secondary creases 60 allow the backing panel 56 to arcuately bend for proper fitting. The secondary creases 60 allow the backing panel 56 to arcuately bend for proper fitting.

The present invention may be embodied in other specific forms without departing from the spirit of essential attributes thereof; therefore, the illustrated embodiment should be considered in all respects as illustrative and not restrictive, reference being made to the appended claims rather than to the foregoing description to indicate the scope of the invention.

I claim:

1. An emblem bearing cap attachment for mounting to a cap having a crown for fitting on a human head with a lower periphery, a rearward portion with an opening along the lower periphery, a band extending around the inside of the lower periphery of the crown and a band size adjustment strap extending from the band across the opening for sizing the cap, the emblem bearing cap attachment comprising:

(a) a substantial planar body of a relatively stiff material defining a forward surface and a rearward surface having a folding line extending centrally across the planar body defining a facing panel and a backing panel respectively above and below the folding line, the folding line facilitating a folding of the body about and capturing and enclosing the adjustment strap to position the rearward surface of the facing panel in confronting relationship with the rearward surface of the backing panel as to close the opening with the facing panel;

(b) secondary radial creases in the backing panel for facilitating an arcuate bending of the backing panel conforming with the adjustment strap and the head; and (c) fastening means on the rearward surface substantially equally spaced from the folding line for securing the panels in confronting relationship just above the adjustment strap to secure and support the cap attachment to the cap.

2. The emblem bearing cap attachment of claim 1, wherein the planar body is made from a material from a group comprising paper, cardboard, kimdura and plastic.

3. The emblem bearing cap attachment of claim 1, wherein the substantial planar body is substantially circular and the folding line is comprised of a primary crease.

4. The emblem bearing cap attachment of claim 1, wherein the fastening means are complimentary hook and loop materials.

5. The emblem bearing cap attachment of claim 1, wherein the facing panel displays any one of the following group comprising a name, an emblem, a crest, an advertisement, an indicia, a trademark and a number.

6. The emblem bearing cap attachment of claim 1, wherein the fastening means are double-sided adhesive tapes.

7. An emblem bearing cap attachment for mounting to a cap having a crown for fitting on a human head with a lower periphery, a rearward portion with an opening along the lower periphery, a band extending around the inside of the lower periphery of the crown and a band size adjustment strap extending from the band across the opening for sizing the cap, the emblem bearing cap attachment comprising:

(a) a substantial planar body of a relatively stiff material from a group comprising paper, cardboard, kimdura and plastic deeming a forward surface and a rearward surface having a folding line extending centrally across the planar body defining a facing panel and a backing panel respectively above and below the folding line, the folding line facilitating a folding of the body about, capturing and enclosing the adjustment strap to position the rearward surface of the facing panel in confronting relationship with the rearward surface of the backing panel as to close the opening with the facing panel;

(b) secondary radial creases in the backing panel for facilitating an arcuate bending of the backing panel conforming with the adjustment strap and the head; and (c) fastening means on the rearward surface for securing the panels in confronting relationship to secure the cap attachment to the cap wherein the fastening means are on the rearward surface of the facing panel and backing panel substantially equally spaced from the folding line as to securely capture the adjustment strap to securely support the cap attachment from above the adjustment strap.

8. The emblem bearing cap attachment of claim 7, wherein the substantial planar body is substantially circular and the folding line is comprised of a primary crease.

9. The emblem bearing cap attachment of claim 7, wherein the fastening means are complimentary hook and loop materials.

10. The emblem bearing cap attachment of claim 7, wherein the facing panel displays any one of the following group comprising a name, an emblem, a crest, an advertisement, an indicia, a trademark and a number.

11. The emblem bearing cap attachment of claim 7, wherein the fastening means are double-sided adhesive tapes.

12. An emblem bearing cap attachment for mounting to a cap having a crown for fitting on a human head with a lower periphery, a rearward portion with an opening along the lower periphery, a band extending around the inside of the lower periphery of the crown and a band size adjustment strap with a width extending from the band across the opening for sizing the cap, the emblem bearing cap attachment comprising:

(a) a substantially planar and circular body of a relatively stiff material defining a forward surface and a rearward surface having a folding line extending centrally across the planar body defining a facing panel and a backing panel respectively above and below the folding line, the folding line facilitating a folding of the body about, capturing and enclosing the adjustment strap to position the rearward surface of the facing panel in confronting relationship with the rearward surface of the backing panel as to close the opening with the facing panel wherein the facing panel displays any one of the following group comprising a name, an emblem, a crest, an advertisement, an indicia, a trademark and a number;

(b) secondary radial creases in the backing panel for facilitating an arcuate bending of the backing panel conforming with the adjustment strap and the head; and (c) fastening means on the rearward surface of the facing panel and backing panel substantially equally spaced from the folding line approximating the width of the adjustment strap as to secure the panels in confronting relationship and to securely capture the adjustment strap to support the cap attachment to the cap.

* * * * *

UNITED STATES PATENT AND TRADEMARK OFFICE

CERTIFICATE OF CORRECTION

PATENT NO. : 5,442,817

DATED : August 22, 1995

INVENTOR(S) : Jon S. Miner

It is certified that error appears in the above-indentified patent and that said Letters Patent is hereby corrected as shown below:

Column 4, line 55, please delete the word "deeming" and insert in its place --defining--.

Signed and Sealed this

Twenty-first Day of November, 1995

*Attest:*

Bruce Lehman

BRUCE LEHMAN

*Attesting Officer*

*Commissioner of Patents and Trademarks*